US005154467A

United States Patent [19]

Lanius et al.

[11] Patent Number: 5,154,467

[45] Date of Patent: Oct. 13, 1992

[54] PORTABLE STORAGE RACK FOR CONTAINERS

[75] Inventors: Charles A. Lanius, Prairie du Sac; Mark Gilbertson, Sauk City, both of Wis.

[73] Assignee: Flambeau Products Corporation, Middlefield, Ohio

[21] Appl. No.: 682,188

[22] Filed: Apr. 8, 1991

[51] Int. Cl.[5] ..... B65D 81/00; A45F 5/00

[52] U.S. Cl. ..... 294/160; 294/143; 220/737

[58] Field of Search ..... 294/141-143, 294/146-148, 159-163, 165, 166; 220/737, 741, 742; 312/201, 244, 246, 247, 248

[56] References Cited

U.S. PATENT DOCUMENTS

| | | | |
|---|---|---|---|
| 3,877,766 | 4/1975 | Seebald | 312/284 |
| 4,193,495 | 3/1980 | Keeley | 294/143 |
| 4,326,746 | 4/1982 | Grihalva | 294/146 |
| 4,526,414 | 7/1985 | Jones | 294/143 |
| 4,561,705 | 12/1985 | Schafer | 312/244 |
| 4,634,193 | 1/1987 | Liu | 312/107 |
| 4,729,474 | 3/1988 | Lanius et al. | 206/315.11 |
| 4,779,914 | 10/1988 | Friedline | 294/161 X |
| 4,901,899 | 2/1990 | Barrett | 294/146 X |

*Primary Examiner*—Margaret A. Focarino
*Assistant Examiner*—Dean J. Kramer
*Attorney, Agent, or Firm*—Michael, Best & Friedrich

[57] ABSTRACT

A portable storage rack for storing and displaying containers comprising a pair of pivotally joined planar base members positionable between a folded position wherein the base members are in back-to-back relation to facilitate easy, compact transport of the storage rack, and an unfolded position where the containers stored on the storage rack are all displayed. Each of the base members includes an outer container supporting surface having opposite ends, and each of the base members is provided with a pair of container support members for removably supporting a pair of containers in end-to-end relation adjacent the respective container supporting surface, each of the containers being slideably insertable between one of the pairs of support members from one of the opposite end portions of the container supporting surfaces so that the containers are always accessible regardless of whether the storage rack is folded or unfolded.

19 Claims, 3 Drawing Sheets

Fig. 2
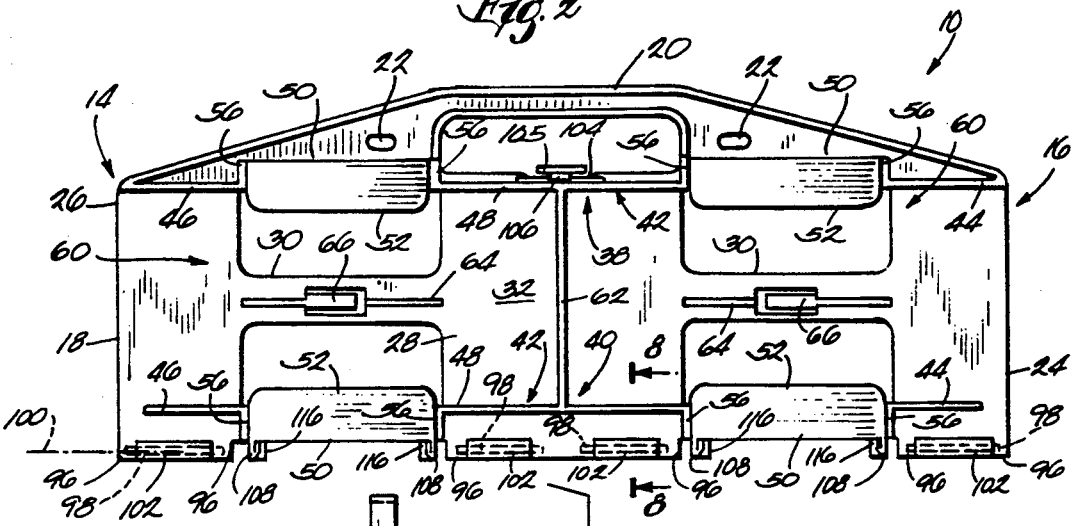
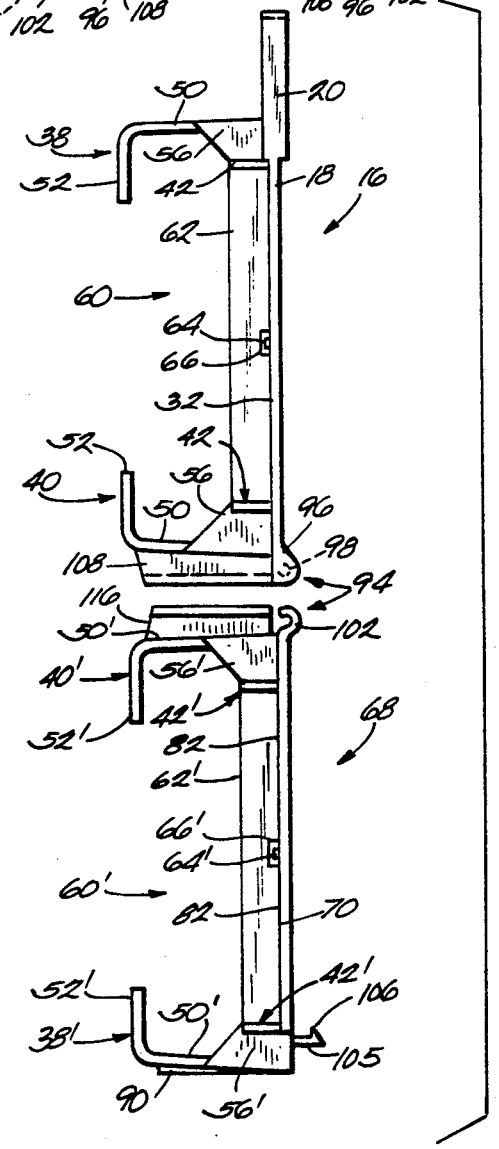
Fig. 5

PORTABLE STORAGE RACK FOR CONTAINERS

BACKGROUND OF THE INVENTION

1. Field of the Invention

The invention relates generally to apparatus for storing objects, and more particularly to a portable rack for storing a plurality of containers each adapted to receive various sized items.

2. Reference to Prior Art

Items including fishing tackle, hardware supplies, hobby supplies, and the like are commonly stored in compartmentalized plastic containers. These containers typically include hinged lids made of clear plastic which provide convenient access and visibility into the interior of the containers. Some of these containers are designed for a particular use. An example of such a container is illustrated in U.S. Pat. No. 4,729,474 which issued Mar. 8, 1988 to Lanius et al., and which shows a fishing tackle box. The tackle box includes both a hinged lid and a drawer for obtaining access to all of the tackle box's many storage compartments.

It is also generally known to store small items in portable cabinets fitted with drawers. Such a cabinet is provided in U.S. Pat. No. 4,634,193 which issued to Liu on Jan. 6, 1987. The cabinet illustrated in Liu includes a framework and a plurality of drawers which slide in and out of the framework.

Other portable storage devices are operational in either free-standing or wall hung positions. U.S. Pat. No. 4,561,705 which issued to Schafer on Dec. 31, 1985 provides an example of this type of storage device. Illustrated in Schafer is a portable storage container including a pair of like housings which are hinged together so that the housings swing about a vertical axis between closed and opened positions. The housings are provided with holes to facilitate hanging the container on a wall. Each of the housings includes drawers or compartments which are only accessible when the storage container is open. A padlock can be used to secure the housings together in the closed position.

Still other portable storage devices are configured to receive and store items in stacked, orderly relation to one another. U.S. Pat. No. 3,877,766 which issued to Seebald on Apr. 15, 1975 illustrates a portable storage and/or carrier device designed for storing and transporting photographic items such as slides. The device includes a housing having rows of compartment sections that extend upwardly from a base and that are adapted to receive the slides in stacked relation. The compartment sections are formed by spaced apart upstanding side walls extending from an upstanding rear wall. Each side wall includes a flange portion at its outer end to provide openings adjacent the forwardmost side of the compartment sections for accessing the slides. The compartment sections are open adjacent the top for receipt and removal of the slides.

SUMMARY OF THE INVENTION

The present invention provides a portable storage rack which removeably supports one or more objects such as containers, and which is designed to facilitate the convenient storage, transport and display of the containers and their contents while affording ready access to the containers.

A storage rack embodying the invention can function as a two-sided carrier for transporting containers and also as a single-sided display case for the containers.

The storage rack comprises a frame including a pair of pivotally joined, generally planar base members each having a normally vertical container supporting surface adjacent which at least one container can be stored. The storage rack can be collapsed by folding the base members together to form a more compact, easily transportable structure in which the container supporting surfaces form opposite exterior sides of the frame. In one embodiment the base members are automatically latched together when folded to hold the storage rack in the collapsed configuration.

The storage rack can also be easily unfolded by simply pressing the latch holding the base members together and pivoting the base members relative to one another so that the container supporting surfaces face in the same direction, thereby forming a single-sided structure wherein all of the containers supported on the storage rack can be viewed at once. In one embodiment the base members are securable in the unfolded position to maintain the storage rack in its single-sided configuration.

The storage rack embodying the invention is preferably free-standing in both the folded and unfolded positions. Alternatively, the storage rack can be hung or mounted on a wall when in the unfolded position. Also, one of the base members includes a handle for carrying or hanging the storage rack.

Additionally, in a preferred embodiment of the invention each base member is provided with means for removably supporting a pair of containers in end-to-end relation adjacent the respective container supporting surfaces. Each supporting means preferably includes a pair of container support members which define therebetween a pair of container storage pockets extending outwardly from one of the container supporting surfaces. To insert a container into one of the storage pockets the container is simply slid through an opening in the pocket from one of the opposite sides or ends of the container supporting surface adjacent which the pocket is located. Appendages or fingers on the base members retain the containers within the pockets during transport. To remove the container the process is reversed. Since the containers are stored on the outside of the storage rack the containers are always accessible.

Thus, it is a primary object of the present invention to provide a storage rack adapted for use by fishermen, handymen, hobbyists, and the like to store containers.

Another object of the present invention is the provision of a portable storage rack which is collapsible or foldable to afford easier and more compact carrying of the storage rack and the objects stored thereon, and which is unfoldable to more completely display the contents of the storage rack. A related object is to provide a storage rack having pivotally joined base members each including an outwardly facing container supporting surface adjacent which containers are stored.

Another object of the present invention is the provision of a storage rack including means for removably supporting at least one object adjacent an exterior supporting surface. A related object is to provide a storage rack wherein the supporting means supports a pair of objects in end-to-end relation so that the objects can be placed on the rack or removed therefrom from the opposite ends of the supporting surface. A further related object is to provide a storage rack wherein the objects are easily inserted into or removed from storage pockets defined by the supporting means regardless of whether the storage rack is folded or unfolded.

Other features and advantages of the invention will become apparent to those skilled in the art upon review of the following detailed description, claims, and drawings.

BRIEF DESCRIPTION OF THE DRAWINGS

FIG. 2 is a front elevational view of the folded storage rack illustrated in FIG. 1 and shown without the containers.

FIG. 5 is an enlarged and exploded view of the storage rack illustrated in FIG. 4.

Figure 1:
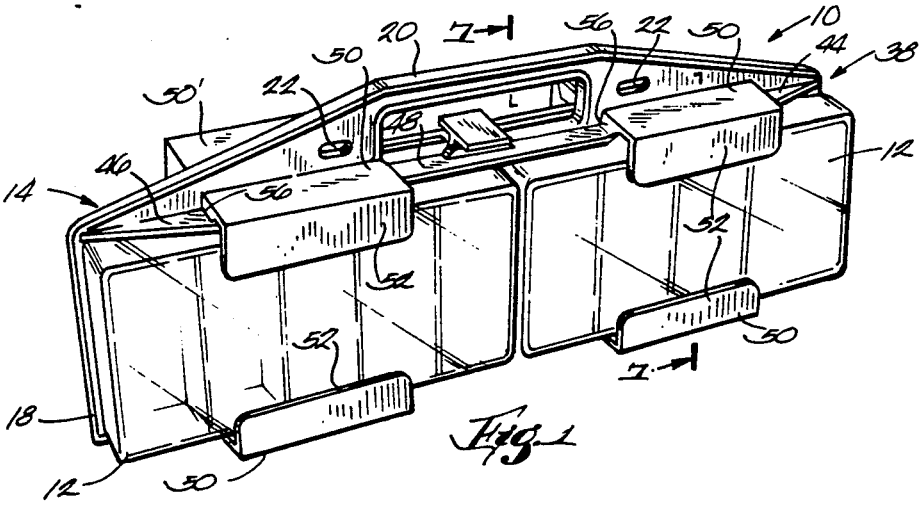
FIG. 1 is a perspective view of a portable storage rack which is shown in a folded position and supporting containers, and which embodies various features of the invention.
Figure 6:
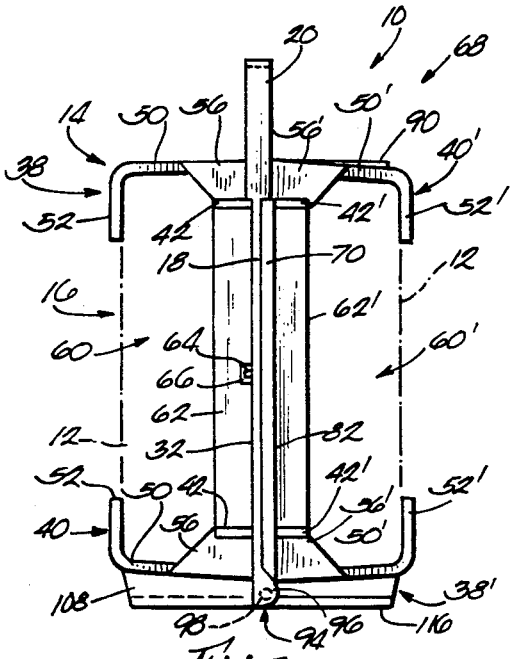
FIG. 6 is an enlarged side view of the storage rack illustrated in FIG. 2.
Figure 7:
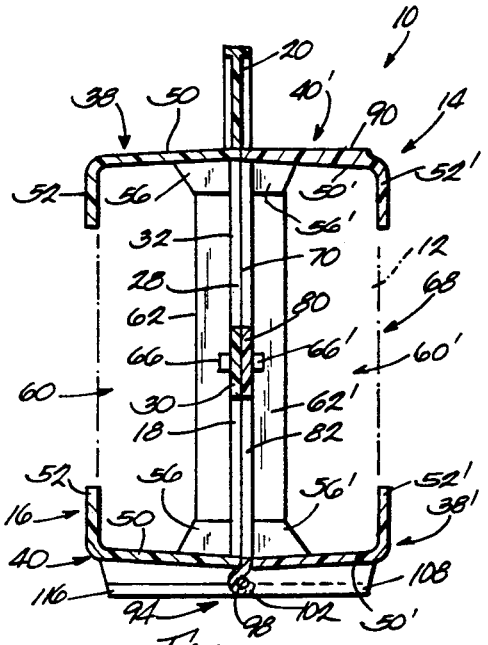
FIG. 7 is a view taken along line 7—7 in FIG. 1.
Figure 9:
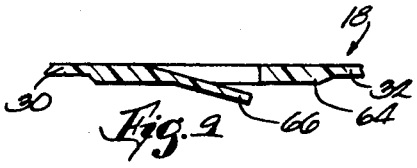
FIG. 9 is a view taken along line 9—9 in FIG. 3.
Figure 10:
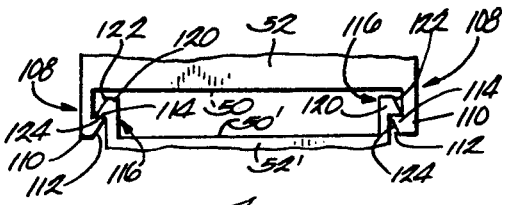
FIG. 10 is a view taken along line 10—10 in FIG. 4.

Before one embodiment of the invention is explained in detail, it is to be understood that the invention is not limited in its application to the details of construction and the arrangement of components set forth in the following description or illustrated in the drawings. The invention is capable of other embodiments and of being practiced or carried out in various ways. Also, it is to be understood that the phraseology and terminology used herein is for the purpose of description and should not be regarded as limiting.

GENERAL DESCRIPTION

Illustrated in FIG. 1 is a portable storage rack 10 embodying the invention and for holding or storing objects such as boxes or containers 12 which are preferably used to store fishing tackle, hardware supplies, hobby supplies, and the like. In other embodiments of the invention the storage rack 10 can be designed for use with various types of containers 12 and can be modified to accommodate containers 12 of various sizes and configurations. In the illustrated arrangement each container 12 is box-like and is preferably made of transparent or translucent material so that the containers 12 are see-through.

The storage rack 10 comprises a frame 14 including a first half or container support portion 16 which is preferably integrally formed. The first support portion 16 includes a generally planar first plate or base member 18 which is preferably maintained in an upright position. As shown in FIG. 2, the base member 18 includes an upper handle section 20 for carrying the storage rack 10 from place to place. One or more mounting holes 22 (two are shown) are provided in the handle section 20 to facilitate supporting the storage rack 10 on a wall (not shown), as will be further explained below. The base member 18 also includes opposite end sections 24 and 26 and a middle section 28 extending downwardly from the handle section 20 and a pair of web sections 30 interconnecting the end sections 24 and 26 with the middle section 28. The end sections 24 and 26, the middle section 28, and the web sections 30 include normally vertical outer surfaces which combine to form a container supporting surface 32.

The first support portion 16 also includes means on the base member 18 for removeably supporting at least one container 12 adjacent the container supporting surface 32. While various supporting means can be employed, in the illustrated construction the supporting means on the base member 18 includes a first or upper container support member 38 and a second or lower container support member 40 in opposed relation to the upper support member 38. The support members 38 and 40 are adapted to support a pair of containers 12 in end-to-end relation therebetween and adjacent the container supporting surface 32.

As shown in FIG. 2, the support members 38 and 40 are similarly constructed and the same reference numerals are used to designate like components on each of the support members 38 and 40. Each of the support members 38 and 40 includes a guide or wall member 42 that extends horizontally from the container supporting surface 32. Each wall member 42 is formed by three horizontally spaced apart segments 44, 46 and 48 respectively positioned on the opposite end sections 24 and 26 and the middle section 28 of the base member 18. Each of the support members 38 and 40 also includes a pair of generally horizontal wall or back portions 50 positioned in the spaces between the segments 24, 26 and 28. Each of the back portions 50 extends from the base member 18 and includes on its outer end a flange portion 52 which is spaced from the container supporting surface 32. Each of the flange portions 52 on the upper support member 38 extends downwardly and each of the flange portions 52 on the lower support member 40 extends upwardly and corresponds to one of the downwardly extending flange portions. Gussets 56 situated between the opposite sides of the back portions 50 and an end of one of the segments 44, 46 and 48 reinforce the back portions 50.

The support members 38 and 40 define therebetween a container storage area which is divided into a pair of container storage pockets 60 by a central partition 62 extending between the respective wall members 42. Containers 12 are placed on the storage rack 10 by simply sliding each container 12 along the container supporting surface 32 and into one of the storage pockets 60 through an open end thereof from one or the other of the opposite end sections 24 and 26. Once the containers 12 are in the storage pockets 60, the corresponding downwardly and upwardly extending flange portions 52 on the upper and lower support members 38 and 40 restrain the containers 12 against the container supporting surface 32. The flange portions 52 define mostly open outermost sides of the storage pockets 60 through which the contents of the see-through containers 12 stored on the storage rack 10 can be viewed. Removal of the containers 12 from the storage rack 10 is accomplished by simply sliding the containers 12 out of the storage pockets 60 with the mostly open outermost sides of the storage pockets 60 affording ready access to the containers 12.

The supporting means on the base member 18 also includes means for retaining the containers 12 adjacent the container supporting surface 32 and within one of the storage pockets 60. While various retaining means can be employed, in the illustrated construction the retaining means includes a rib 64 on each of the web sections 30. The ribs 64 help ensure that the containers 12 fit snugly into the storage pockets 60 by facilitating secure contact between the containers 12 and the flange portions 52 which resiliently compensate for the ribs 64.

The retaining means also includes a pair of resilient tensioning members or fingers 66 which each extend from one of the web sections 30 into one of the storage pockets 60. Each of the fingers 66 is engageable with a container 12 to bias the container 12 toward a pair of corresponding flange portions 52 so that contact is maintained between the container and the flange portions 52. Thus, the fingers 66 function to take up unused space within the storage pockets 60 to facilitate storing containers of varying sizes on the storage rack 10 and to reduce the chances of accidental withdrawal of the containers 12 from the storage rack 10.

While in the illustrated arrangement each of the storage pockets 60 is provided with a rib 64 and a finger 66, in other constructions one or more of the storage pockets 60 can be provided with only one or neither of the rib 64 and finger 66.

Figure 3:
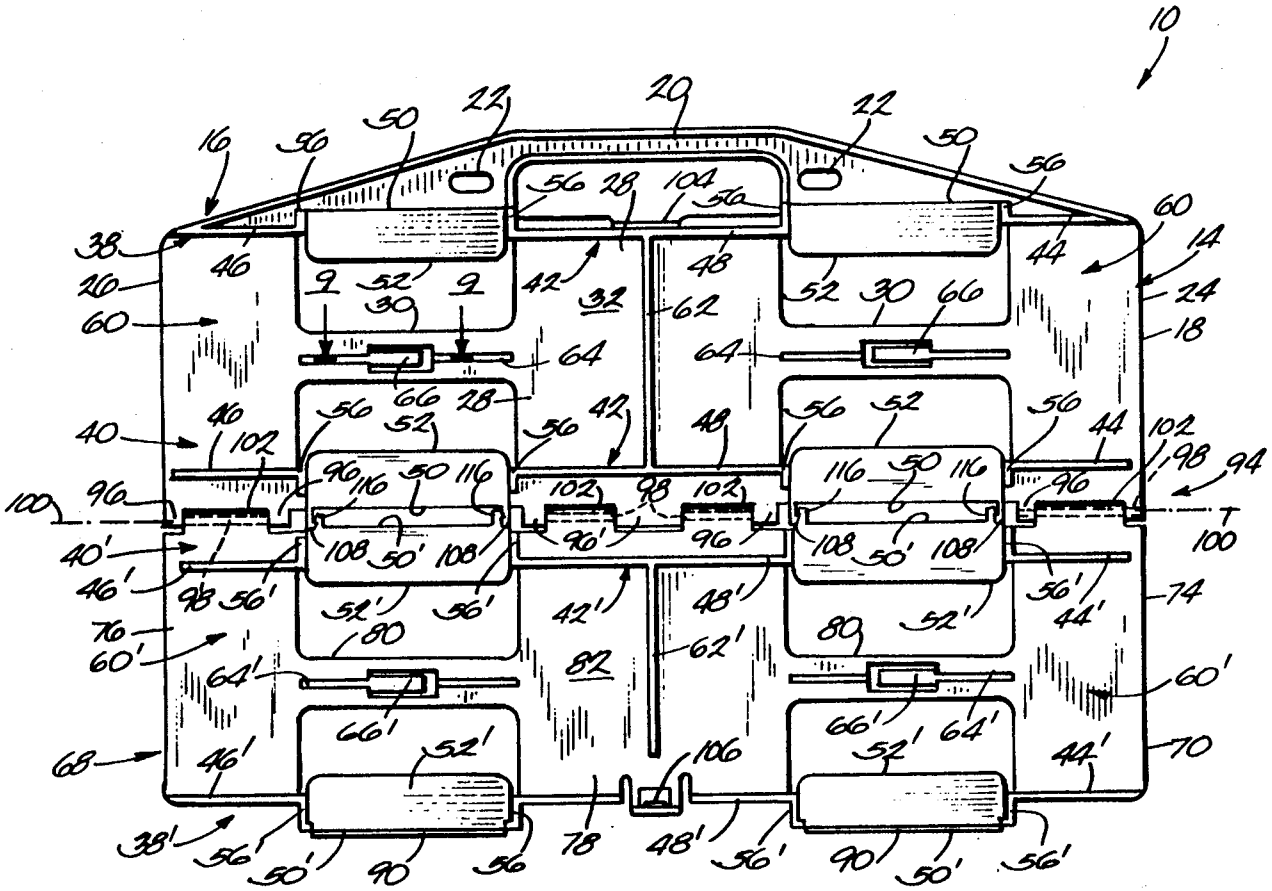
FIG. 3 is a front elevational view of the storage rack illustrated in FIG. 2 and shown unfolded.

The frame 14 also includes a second half or container support portion 68 which is similar in many respects to the first support portion 16. As shown in FIG. 3, the second support portion 68 is also preferably integrally formed and includes a generally planar second plate or base member 70 which is swingable or pivotable relative to the base member 18 so that the storage rack 10 can be folded and unfolded, as will be further explained below. Like the base member 18, the base member 70 includes opposite end sections 74 and 76, a middle section 78 and a pair of web sections 80 interconnecting the end sections 74 and 76 with the middle section 80. The end sections 74 and 76, the middle section 78, and the web sections 80 include normally vertical outer surfaces which combine to form a container supporting surface 82.

The second support portion 68 also includes means on the base member 70 for removeably supporting at least one container 12 adjacent the container supporting surface 82. In the illustrated arrangement, the supporting means on the base member 70 is constructed substantially identically to the supporting means on the base member 18. Accordingly, the same reference numerals are used to refer to common components on the supporting means respectively on the base members 18 and 70, except that a prime notation (') is added to numerals associated with the supporting means on the base member 70.

As shown in FIG. 3, the supporting means on the base member 70 includes container support members 38' and 40' which alternate between upper and lower positions depending on whether the storage rack 10 is folded or unfolded. The construction and use of the support members 38' and 40' is substantially the same as is described above and will not be further explained, except to note that the back portions 50' on the support member 38' are supported below the base member 70 when the storage rack 10 is unfolded. (FIG. 3)

Figure 4:
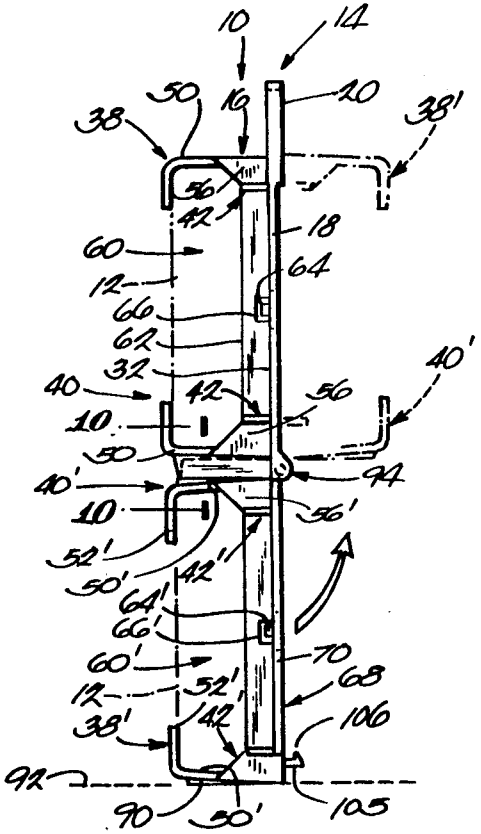
FIG. 4 is a side elevation view of the storage rack illustrated in FIG. 3.

As shown in FIG. 4, each of the back portions 50' on the support member 38' is provided with a generally horizonal surface portion 90. When the storage rack 10 is unfolded it is supportable in an upright, free standing position on a horizontal surface 92 by the surface portions 90.

The frame 14 also includes means for pivotally joining the base members 18 and 70 together so that the first and second container support portions 16 and 68 are relatively pivotable. While various joining means can be employed, in the illustrated construction the joining means includes a hinge assembly 94 which enables the first and second support portions and 16 and 68 to pivot relative to one another in book-like fashion so that the frame 14 is collapsible or foldable. Specifically, the first and second support portions 16 and 68 are pivotable relative to one another between a collapsed or folded position (shown in broken lines in FIG. 4) wherein the base members 18 and 70 are in back-to-back relation and the container supporting surfaces 32 and 32' form opposite outwardly facing sides of the frame 14, and an unfolded position (shown in solid lines in FIG. 4) wherein the base members 18 and 70 are in generally stacked relation with the container supporting surfaces 32 and 82 being generally coplanar and facing in the same direction.

Figure 8:
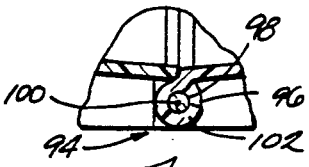
FIG. 8 is a view taken along line 8—8 in FIG. 2.

As shown in FIGS. 2 and 3, the hinge assembly 94 includes a plurality of pin supports 96 extending downwardly from the lower edge portion of the first base member 18 and a plurality of pivot bars or pins 98. The pivot pins 98 are aligned along a common generally horizontal axis 100 and are supported on opposite ends by adjacent pin supports 96. The hinge assembly 94 also includes a plurality of hook members 102 (see FIG. 5) positioned along an edge portion of the base member 70 in corresponding relation to the pivot pins 98. Each pivot pin 98 is received in one of the hook members 102 so that the base members 18 and 70 are relatively pivotal about the axis 100 (see FIG. 8).

While in the illustrated construction the frame 14 includes relatively pivotable first and second container support portions 16 and 68, in other constructions the frame 14 can include one or more container support portions and the support portions need not be moveable relative to one another. Hence, in other constructions the storage rack 10 may not be foldable and can be either a single-sided or a multi-sided structure.

The frame 14 also includes means for releaseably latching the base members 18 and 70 together in the folded position so that the storage rack 14 can be easily secured in a compact, collapsed configuration. While various latching means can be employed, in the illustrated construction the latching means includes a lip 104 along the upper edge of base member 18, and a latch member 105 resiliently supported on the base member 70. The latch member 105 includes at one end a catch 106 which is engageable with the lip 104 to secure the base members 18 and 70 in back-to-back relation.

When the first and second support portions 16 and 68 are folded together so that the base members 18 and 70 are in back-to-back relation the catch 106 on the latch member 105 automatically captures the lip 104 to secure the base members 18 and 70 together. To unfold the storage rack 10 the end of the latch member 105 opposite the catch 106 is pressed downwardly to pivot the latch member 105 and to disengage the catch 106 from the lip 104 so that the base members 18 and 20 are again relatively pivotable.

The storage rack 10 also comprises means for releaseably securing or locking the first and second support portions 16 and 68 in the unfolded position. While various locking means can be employed, in the illustrated construction the locking means includes a pair of resilient, spaced apart and inwardly facing locking legs 108 extending downwardly from each of the back portions 50 of the support member 40. Each of the inwardly facing legs 108 includes a head 110 having a slanted surface 112 which terminates at a rounded hook or barb portion 114.

The locking means also includes a pair of resilient, spaced apart and outwardly facing locking legs 116 extending from each of the back portions 50' of the support member 40. Each of the outwardly facing legs 116 corresponds to one of the inwardly facing legs 108 and includes a head portion 120 having a slanted surface 122 which terminates at a rounded hook or barb portion 124. When the storage rack 10 is folded the outwardly facing legs 116 extend downwardly so that the inwardly and outwardly facing legs 108 and 116 cooperate to support the storage rack 10 in an upright freestanding position when placed on a generally horizontal surface. When the storage rack 10 is unfolded the cooperating inwardly and outwardly facing legs 108 and 116 engage one another along the slanted surfaces 112 and 122 to resiliently urge the heads 110 and 120 away from one another. When the storage rack 10 is completely unfolded the slanted surfaces 112 and 122 of the corresponding legs 108 and 116 end their engagement so that the head portions 110 and 120 snap back to interlock the barb portions 114 and 124 thereby securing the storage rack 10 in the unfolded position. The rounded barb portions 114 and 124 facilitate the release of the base members 18 and 70 from the unfolded position when the base members 18 and 70 are pivoted relative to one another. However, due to the configuration of the head portions 110 and 120, pivoting the base members 18 and 70 from the locked unfolded position generally requires more force than does pivoting the base members 18 and 70 to the locked unfolded position.

The storage rack 10 is easily disassembled when in the unfolded position by moving the second support portion 68 rearwardly relative to the first support portion 16 to disengage or unsnap the pivot pins 98 from the hook members 102. (see FIG. 5) Similarly, the support portions 16 and 68 are easily reassembled by snapping the pivot pins 98 back into the hook members 102.

Advantageously, the storage rack 10 is useable as a freestanding structure to conveniently carry or display containers 12. The storage rack 10 is easily foldable to provide a compact two-sided structure in which a plurality of containers 12 can be transported. The storage rack 10 can also be unfolded to display all of the containers 12 supported on the storage rack 10 at once. The mounting holes 22 provided in the storage rack 10 enable the storage rack 10 to be supported or mounted on a wall while in the unfolded position using hooks, fasteners, or the like.

Additionally, the mostly open outermost sides of the storage pockets 60 and 60' permit the contents of the see-through containers 12 to be observed without removing the containers 12 from the storage rack 10' while at the same time providing ready access to the containers 12 if their removal from the storage rack 10 is desired. Also, it is noted that the containers 12 are slid along the container supporting surfaces 32 and 82 in a direction generally parallel to the axis 100 when being inserted into and removed from the storage pockets 60 and 60'. Thus, the containers 12 are always accessible regardless of whether the storage rack 10 is folded or unfolded.

Other features and advantages of the invention are set forth in the following claims.

We claim:

1. A portable container storage rack comprising:

a pair of containers;

a frame including a container supporting surface having opposite end portions; and means for releasably supporting said pair of containers in end-to-end relation adjacent said container supporting surface, said means for releasably supporting said pair of containers including a pair of spaced apart container support members each extending outwardly from said container supporting surface, one of said container support members having a pair of downwardly extending flange portions, and the other end of said support members having a pair of upwardly extending flange portions, one of each of said upwardly and downwardly extending flange portions being engageable with one of said containers to restrain said one container adjacent said container supporting surface, and the other of each of said upwardly and downwardly extending flange portions being engageable with the other of said containers to restrain said other container adjacent said container supporting surface, one of said containers being slideably insertable between said container support members from one of said opposite end portions and the other of said containers being slideably insertable between said container support members from the other of said opposite end portions.

2. A storage rack as set forth in claim 1, wherein said frame includes a first base member having said container supporting surface, and a second base member pivotally joined to said first base member.

3. A storage rack as set forth in claim 2, wherein each of said first and second base members is generally planar, and said second base member includes a container supporting surface having opposite end portions, wherein said storage rack further includes another pair containers, and means for releasably supporting said other pair of containers in end-to-end relation adjacent said container supporting surface of said second base member, and wherein said first and second base members are pivotable relative to one another between a folded position in which said first and second base members are in back-to-back relation and said container supporting surfaces form opposite exterior sides of said frame, and an unfolded position in which said first and second container supporting surfaces face in the same direction.

4. A storage rack as set forth in claim 3, wherein said means for releasably supporting said first mentioned pair of containers on said first base member and said means for releasable supporting said second mentioned pair of containers on said second base member support said pairs of containers in side-by-side relation to one another when said first and second base members are in said unfolded position.

5. A storage rack as set forth in claim 3, wherein said base members pivot relative to one another about a generally horizontal axis.

6. A storage rack as set forth in claim 3, wherein said frame includes means for releasably latching said base members in said folded position, said means for releaseably latching including a lip member on one side of said first and second base members, and a resilient latch member on the other side of said first and second base members, wherein said latch member captures said lip member when said first and second base members are in said folded position to latch said first and second base members in back-to-back relation, and wherein said latch member releases said lip member when said latch member is resiliently biased away from said lip member.

7. A storage rack as set forth in claim 3, wherein said means for releaseably supporting said other pair of containers adjacent said container supportin surface of said second base member includes a pair of spaced apart container support members extending outwardly from said container supporting surface of said second base member and being adapted to house said other pair of containers therebetween, and wherein one of said container support members on one of said first and second base members includes a generally horizontal back portion positioned below each of said first and second base members when said first and second base members are in said unfolded position, said back portion being adapted to support said frame in an upright position with said first and second base members in vertically stacked relation to one another when said frame is placed on a generally horizontal surface and said base members are in said unfolded position.

8. A storage rack as set forth in claim 3, wherein said means for releasably supporting said other pair of containers adjacent said container supporting surface of said second base member includes a pair of spaced apart container support members extending outwardly from said container supporting surface of said second base member and being adapted to house said other pair of containers therebetween, and wherein said storage rack includes means for releaseably locking said first and second base members in said unfolded position, aid means for locking including a pair of resilient first leg members extending from one of said container support members of one of said first and second base members, and a pair of resilient second leg members extending from one of said container support members of the other of said first and second base members, said pair of second leg members extending downwardly when said first and second base members are in said folded position and upwardly when said first and second base members are in said unfolded position, and each of said second leg members corresponding to one of said first leg members, and wherein each of said second leg members slideably engages the corresponding first leg member when said first and second base members are pivoted toward said unfolded position, and each of said second leg members interlocks with the corresponding first leg member when said first and second base members are in said unfolded position.

9. A storage rack as set forth in claim 1, wherein said frame includes a pair of normally vertical container supporting surfaces, said container supporting surfaces forming opposite exterior sides of said frame, and means for releaseably supporting a pair of containers in end-to-end relation adjacent each of said container supporting surfaces.

10. A storage rack as set forth in claim 1, wherein said container support members define therebetween a pair of storage pockets, and wherein said means for releaseably supporting includes a resilient member supported on said frame and engageable with the one of said containers received in the corresponding one of said storage pockets to retain said one container in said one storage pocket.

11. A storage rack as set forth in claim 1, wherein said container support members includes a pair of flange portions, each of said flange portions being spaced from said container supporting surface, and wherein each of said flange portions is adapted to engage one of the containers to restrain the containers adjacent said container supporting surface.

12. A storage rack as set forth in claim 1, wherein said containers are made of a see-through material, and wherein said container support members define therebetween a pair of storage pockets for receiving said containers, said storage pockets each having a mostly open outermost side such that the contents of said containers are viewable through said containers while said containers are supported in said storage pockets.

13. A portable storage rack for supporting containers, said storage rack comprising:

a frame including a container supporting surface having opposite end portions; and means for releaseably supporting a pair of containers in end-to-end relation adjacent said container supporting surface, said means for releaseably supporting a pair of containers including a pair of spaced apart container support members each extending outwardly from said container supporting surface, said container support members being adapted to house the pair of containers therebetween, one of the containers being slideably insertable between said container support members from one of said opposite end portions and the other of the containers being slideably insertable between said container support members from the other of said opposite end portions, and said pair of container support members including an upper support member having a pair of downwardly extending flange portions, and a lower support member having a pair of upwardly extending flange portions, one of each of said upwardly and downwardly extending flange portions being adapted to engage one of the containers to restrain the one container adjacent said container supporting surface, and the other of each of said upwardly and downwardly extending flange portions being adapted to engage the other of the containers to restrain the other container adjacent said container supporting surface.

14. A storage rack as set forth in claim 13, wherein said container support members define therebetween a storage pocket adapted to receive a container, one of said upwardly extending flange portions and one of said downwardly extending flange portions defining a mostly open outermost side of said storage pocket.

15. A storage rack as set forth in claim 13, wherein said storage rack includes another pair of containers, wherein said frame includes first and second generally planar base members each including an outwardly facing container supporting surface having opposite end portions, said first and second base members being pivotable relative to one another for movement between a folded position in which said first and second base members are in back-to-back relation and said container supporting surfaces form opposite exterior sides of said frame, and an unfolded position in which said first and second container supporting surfaces face in the same direction, and wherein said storage rack further includes means for releaseably supporting said other pair of containers adjacent said container supporting surface of said second base member, said means for releaseably supporting said other pair of containers including a pair of spaced apart container support members extending outwardly from said container support surface of said second base member, and wherein said pair of containers supported adjacent said container supporting surface of said first base member and said other pair of containers supported adjacent said container supporting surface of said second base member are in side-by-side relation to one another when said base members are in said unfolded position.

16. A portable storage rack for supporting containers, said storage rack comprising:

a frame including first and second generally planar base members including respective first and second normally vertical and outwardly facing container supporting surfaces, said base members being pivotally joined together so that said base members are positionable between a folded position wherein said base members are in back-to-back relation and said container supporting surfaces face in opposite directions from one another, and an unfolded position wherein said container supporting surfaces face in the same direction, and said frame including means on at least one of said first and second base members for releaseably latching said base members in said folded position, said means for releaseably latching including a lip member on one of said first and second base members, and a resilient latch member on the other of said first and second base members, wherein said latch member captures said lip member when said first and second base members are in said folded position to latch said first and second base members in back-to-back relation, and wherein said latch member releases said lip member when said latch member is resiliently biased away from said lip member;

first means on said first base member for removeably supporting a container adjacent said first container supporting surface, said first means including a pair of spaced apart first container support members extending outwardly from said first container supporting surface and being adapted to house a container therebetween;

second means on said second base member for removeably supporting a container adjacent said second container supporting surface, said second means including a pair of spaced apart second container support members extending outwardly from said second container supporting surface and being adapted to house a container therebetween.

17. A portable storage rack for supporting containers, said storage rack comprising:

a frame including first and second generally planar base members including respective first and second normally vertical and outwardly facing container supporting surfaces, said base members being pivotally joined together so that said base members are positionable between a folded position wherein said base members are in back-to-back relation and said container supporting surfaces face in opposite directions from one another, and an unfolded position wherein said container supporting surfaces face in the same direction;

first means on said first base member for removeably supporting a container adjacent said first container supporting surface, said first means including a pair of spaced apart first container support members extending outwardly from said first container supporting surface and being adapted to house a container therebetween; and second means on said second base member for removeably supporting a container adjacent said second container supporting surface, said second means including a pair of spaced apart second container support members extending outwardly from said second container supporting surface and being adapted to house a container therebetween, wherein one of said container support members on one of said first and second base members includes a generally horizontal back portion positioned below each of said first and second base members when said first and second base members are in said unfolded position, and wherein said back portion is adapted to support said frame in an upright position with said first and second base members in vertically stacked relation to one another when said frame is placed on a generally horizontal surface and said base members are in said unfolded position.

18. A portable storage rack for supporting containers, said storage rack comprising:

a frame including first and second generally planar base members including respective first and second generally planar base outwardly facing container supporting surfaces, said base members being pivotally joined together so that said base members are positionable between a folded position wherein said base members are in back-to-back relation and said container supporting surfaces face in opposite directions from one another, and an unfolded position wherein said container supporting surfaces face in the same direction;

first means on said first base member for removeably supporting a container adjacent said first container supporting surface, said first means including a pair of spaced apart first container support members extending outwardly from said first container supporting surface and being adapted to house a container therebetween;

second means on said second base member for removeably supporting a container adjacent said second container supporting surface, said second means including a pair of spaced apart second container support members extending outwardly from said second container supporting surface and being adapted to house a container therebetween; and means for releaseably locking said first and second base members in said unfolded position, said means for locking including a pair of resilient first leg members extending from one of said container support members of one of said first and second base members, and a pair of resilient second leg members extending from one of said container support members of the other of said first and second base members, said pair of second leg members extending downwardly when said first and second base members are in said folded position and upwardly when said first and second base members are in said unfolded position, and each of said second leg members corresponding to ne of sad first leg members, wherein each of said second leg members slideably engages the corresponding first leg member when said first and second base members are pivoted toward said unfolded position, and interlocks with the corresponding first leg member when said first and second base members are in said unfolded position.

19. A portable storage rack for supporting containers, said storage rack comprising:

a frame including first and second generally planar base members including respective supporting surfaces each having opposite end portions, said first and second base members being pivotally joined together so that said base members are shiftable relative to one another about a generally horizontal axis between a folded position wherein said base members are in back-to-back relation and said container supporting surfaces form opposite exterior sides of said frame, and an unfolded position wherein said container supporting surfaces face in the same direction, and means for releasable latching said first and second base members in said folded position, said means for releaseably latching including a lip member on one of said first and second base members and a resilient latch member on the other of said first and second base members, said latch member releaseably capturing said lip member when said first and second base members are in said folded position;

first means for removeably supporting a pair of containers in end-to-end relation adjacent said container supporting surface of said first base member, said first means including a pair of spaced apart container support members on said first base member and including an upper support member having a pair of downwardly extending flange portions, and a lower support member having a pair of upwardly extending flange portions, each of said flange portions being spaced from said container supporting surface of said first base member and adapted to engage a container to restrain the container adjacent said container supporting surface of said first base member, one of the containers being slideably insertable between said upper and lower support members and beneath one of each of said upwardly and downwardly extending flange portions from one of said opposite end portions of said container supporting surface of said first base member, and the other container being slideably insertable between said upper and lower support members and beneath the other of each of said upwardly and downwardly extending flange portions from the other of said opposite end portions of said container supporting surface of said first base member;

second means for removeably supporting a pair of containers in end-to-end relation adjacent said container supporting surface of said second base member, said second means including a pair of spaced apart container support members on said second base member and being adapted to house a pair of containers therebetween, one of the containers being slideably insertable between said container support members on said second base member from one of said opposite end portions of said container supporting surface of said second base member, and the other container being slideably insertable between said container support members on said second base member from the other of said opposite end portions of said container supporting surface of said second base member; and means for locking said first and second base members in said unfolded position, said means for locking including a pair of resilient first leg members extending downwardly from said lower support member, and a pair of resilient second leg members which extend downwardly from one of said container support members on said second base member when said first and second base members are in said folded position and which extend upwardly from said one container support member on said second base member when said first and second base members are in said unfolded position, each of said second leg members corresponding to one of said first leg members, wherein each of said second leg members slideably engages the corresponding first leg member when said first and second base members are pivoted toward said unfolded position, and interlocks with the corresponding first leg member when said first and second base members are in said unfolded position.

* * * * *

UNITED STATES PATENT AND TRADEMARK OFFICE

CERTIFICATE OF CORRECTION

PATENT NO. : 5,154,467

DATED : October 13, 1992

INVENTOR(S) : Charles A. Lanius et al.

It is certified that error appears in the above-identified patent and that said Letters Patent is hereby corrected as shown below:

Claim 1, Col. 8, Ln. 9, delete "end".

Claim 6, Col. 8, Ln. 2, delete "side".

Claim 8, Col. 9, Ln. 28, delete "aid" and insert therefor --said--.

Claim 11, Col. 9, Ln. 63, delete "includes" and insert therefor --include--.

Claim 18, Col. 12, Lns. 18-19, delete "generally planar base" and insert therefor --normally vertical and--.

Claim 18, Col. 12, Ln. 54 delete "ne" and insert therefor --one--.

Signed and Sealed this

Twelfth Day of October, 1993

*Attest:*

*Attesting Officer*

Bruce Lehman

BRUCE LEHMAN

*Commissioner of Patents and Trademarks*